US006532720B2

(12) United States Patent
Anderson

(10) Patent No.: US 6,532,720 B2
(45) Date of Patent: Mar. 18, 2003

(54) PACKAGING METHOD USING ELASTIC MEMORY FOAM AS SAFETY INDICATOR FOR HEAT DAMAGE

(75) Inventor: D. W. Anderson, Middletown, NY (US)

(73) Assignee: International Paper Company, Stamford, CT (US)

( * ) Notice: Subject to any disclaimer, the term of this patent is extended or adjusted under 35 U.S.C. 154(b) by 62 days.

(21) Appl. No.: 09/797,455

(22) Filed: Mar. 1, 2001

(65) Prior Publication Data

US 2002/0073654 A1 Jun. 20, 2002

Related U.S. Application Data

(60) Provisional application No. 60/256,239, filed on Dec. 15, 2000.

(51) Int. Cl.[7] ..... B65B 23/22; B65B 3/04

(52) U.S. Cl. ..... 53/472; 53/474; 206/459.1

(58) Field of Search ..... 53/474, 472, 438; 206/524

(56) References Cited

U.S. PATENT DOCUMENTS

| | | | | |
|---|---|---|---|---|
| 3,027,286 A | | 3/1962 | Kurhan | 156/264 |
| 3,253,064 A | | 5/1966 | Buonaiuto | 264/24 |
| 3,420,363 A | | 1/1969 | Blickensderfer | 206/46 |
| 3,616,158 A | * | 10/1971 | Rubens et al. | 156/79 |
| 3,786,777 A | * | 1/1974 | Smith et al. | 116/206 |
| 4,193,899 A | * | 3/1980 | Brenner et al. | 138/103 |
| 4,267,927 A | | 5/1981 | English | 206/524 |
| 4,738,364 A | | 4/1988 | Yeager | 206/563 |
| 4,889,252 A | | 12/1989 | Rockom et al. | 220/3.1 |
| 4,925,508 A | | 5/1990 | Goto et al. | 156/79 |
| 4,997,694 A | * | 3/1991 | Legare | 428/304.4 |
| 5,258,212 A | | 11/1993 | Tomaru et al. | 428/36.8 |
| 5,356,009 A | | 10/1994 | Lubowitz | 206/524 |
| 5,368,905 A | | 11/1994 | Ohno | 428/34.1 |
| 5,506,300 A | * | 4/1996 | Ward et al. | 525/123 |
| 5,720,555 A | | 2/1998 | Elele | 374/150 |
| 5,964,181 A | * | 10/1999 | Pereyra et al. | 116/206 |

* cited by examiner

*Primary Examiner*—Rinaldi I. Rada
*Assistant Examiner*—Paul Durand
(74) *Attorney, Agent, or Firm*—Ostrager Chong & Flaherty LLP

(57) ABSTRACT

An open cell foam with thermal memory characteristic is used as an indicator for heat damage to an article containing heat sensitive contents packaged in a carton. The foam material may be a polyurethane-based thermoplastic polymer referred to as "Cold Hibernated Elastic Memory" (CHEM) foam. The thermal memory foam can be produced in compressed form and used as inserts in the carton. Upon exposure to a temperature at or above the foam glass transition temperature, the foam insert expands to substantially its original shape (volume) so as to apply a compressive force against the article, making it difficult to remove from the carton. Alternatively, the expanded foam will deform the carton walls, providing an external indication of heat damage. The foam can also be used as a heat-indicating element in an inspection panel of the carton, which ruptures so as to provide external indication of heat damage.

21 Claims, 4 Drawing Sheets

PACKAGING METHOD USING ELASTIC MEMORY FOAM AS SAFETY INDICATOR FOR HEAT DAMAGE

PRIORITY CLAIM

This application claims the priority date of, and incorporates by reference, pending U.S. Provisional Patent Application No. 60/256,239, which was filed on Dec. 15, 2000.

TECHNICAL FIELD

This invention generally relates to the use of foam materials for packaging applications, and more particularly, to the use of elastic memory foam for detection of heat damage to the carton contents.

BACKGROUND OF INVENTION

Foam materials have been widely used for thermal insulation and shock absorption in packaging of fragile or heat sensitive contents. In U.S. Pat. No. 3,420,363 to Blickensderfer, methods for forming and using open-celled foam materials having "thermal memory" are disclosed. Foams found to have thermal memory characteristics include those produced from butadiene liquid polymer and suitable amounts of an activator and sulfur monochloride. The foam materials can be foamed, heated to a softened state, compressed and cooled to a densified state of about 20% its original volume in which it can be worked, then subsequently heated to an elevated temperature of about 150° F. to 300° F. to re-expand the foam to its original volume. In one application, the compressed foam can be laminated or adhered to various packaging substrates or used as panels or inserts in a carton, then re-expanded to form a snug, shock-absorbing cushion for an article packaged in the carton. In another application, the article is wrapped in a sheet of densified foam and inserted in an enclosing carton, then the foam is re-expanded to immobilize and cushion the article in the carton. In yet another application, the densified foam can be incorporated in a structure of reduced volume, to facilitate transportation, then re-expanded to its greater volume at the point of use.

Recently, a new class of open cellular foam materials have been developed for space applications at the Jet Propulsion Laboratory, California Institute of Technology, Pasadena, Calif., in conjunction with Nagoya R×D Center, Mitsubishi Heavy Industry, Nagoya, Japan. These foam materials are described in the proceedings of SPIE '99 International Symposium on Smart Structures and Materials, March 1999, Newport Beach, Calif., in an article entitled "Cold Hibernated Elastic Memory (CHEM) Self-Deployable Structures", by W. Sokolowski, A. Chmielewski, S. Hayashi, and T. Yamada. The foam materials are polyurethane-based thermoplastic polymers with a wide glass transition temperature Tg range. They can be compressed to as little as 5% of their original volume and re-expanded at the point of use. The material's memory shape function allows repeated shape changes and shape retention. They are proposed for use as low weight, small volume materials in their densified state that are expandable for large, deployable space structures.

SUMMARY OF INVENTION

While the prior art has shown the use of thermal memory foam materials as insulative and shock-absorbing packaging materials, and for thermal re-expansion to field-deployable larger volume structures, the present invention seeks to use the thermal memory characteristic of the foam materials for other purposes, namely packaging safety applications as an indicator of heat damage or exposure to elevated or unacceptable high temperatures.

In accordance with a first preferred embodiment of the present invention, a method for packaging an article which contains heat-sensitive contents that may be damaged by heat above a predetermined threshold temperature Tt comprises: selecting an open cellular foam material having a thermal memory characteristic at a glass transition temperature Tg which is approximately equal to or greater than the heat-damage temperature threshold of the contents of the article; forming the foam material to an original foamed volume OV; heating the foam material to a temperature greater than or equal to its glass transition temperature Tg; compressing it at this elevated temperature to a selected densified volume DV; cooling the densified foam material to a temperature below its Tg to retain it in the densified state; applying the densified foam material around an article in a carton leaving a free space in the carton which is defined as the quantity (OV−DV) multiplied by a "volume factor" Y. This free space may be between the article and the foam material, or between the carton walls (side, top, bottom) and the foam material, or any combination thereof. When heat is applied to the carton in such a manner that the foam temperature exceeds its Tg, the foam material tends to re-expand to substantially its original volume OV, resulting in a visible or physical indication that the package contents may have been exposed to a temperature above the predetermined threshold temperature.

If the design packaging system is such that volume factor Y is equal to or greater than 1, there will be visible indication of potential heat damage upon inspecting the interior of the package, as the expanded foam will occupy a noticeable percentage of what was originally free space inside the package. When volume factor Y is less than 1, the expanded foam will occupy essentially all of the available free space in the package, and will exert force upon either the package contents, the package walls, or, in most cases, both the contents and the walls. In this case, the package walls will tend to bulge outward, providing rapid visual indication of exposure to elevated temperatures. If the stiffness of the package walls is such that they resist deformation, the expanded foam will produce an inward force on the contents of the package, making the removal of the contents difficult. In all cases and regardless of package wall stiffness, if Y is less than 1, this inward force will be present to some degree and will tend to make removal of package contents difficult without destroying the package.

As used herein, substantially its original volume shall mean a volume that is less than or equal to its original volume.

In accordance with another embodiment of the invention, a method for packaging an article which contains heat-sensitive contents that may be damaged by heat above a predetermined threshold temperature comprises: selecting an open cellular foam material having a thermal memory characteristic at a glass transition temperature Tg which is approximately equal to or greater than the heat-damage temperature threshold of the contents of the article; forming the foam material to an original foamed volume OV; compressing it at an elevated temperature above its glass transition temperature Tg to a selected densified volume DV; cooling the densified foam material to a temperature below its Tg to retain it in the densified state; applying the densified foam material to a heat-damage-indicating panel located on a wall of the carton having an inner surface adjacent the article and an outer surface visible externally of the carton which is rupturable by the re-expanded foam material applied to the heat-damage-indicating panel, such that when a temperature exceeding the glass transition temperature Tg is applied to the carton and the foam material in the heat-damage-indicating panel, the foam material is re-expanded to substantially its original volume OV to rupture the outer surface of the panel and thereby indicate that the contents of the article may be heat-damaged.

Other objects, features, and advantages of the present invention will be explained in the following detailed description of the invention having reference to the appended drawings.

DETAILED DESCRIPTION OF INVENTION

The preferred open cellular foam material with thermal memory characteristic as used in the present invention is a polyurethane-based thermoplastic polymer of the type described in the previously mentioned article entitled "Cold Hibernated Elastic Memory (CHEM) Self-Deployable Structures", by W. Sokolowski, A. Chmielewski, S. Hayashi, and T. Yamada (Sokolowski Article). The CHEM foam material has a wide glass transition temperature Tg range that can be selected anywhere in the range from −158° F. to +158° F. (−70° C. to +70° C.) This range is suitable for using the CHEM foam material as an indicator for heat damage to contents such as pharmaceuticals which can become denatured or chemically changed when exposed to heat above a heat-damage threshold temperature of about 120° F. and higher. If it is desired to use a foam material as an indicator for heat damage to contents at a higher threshold temperature, other shape-memory foam materials may be used, such as those described in U.S. Pat. No. 3,420,363 to Blickensderfer which have a glass transition temperature in the range of 150° F. to 300° F. While the examples described herein employ the CHEM foam material as a heat-damage indicator for pharmaceuticals, it is to be understood that the principles of the invention may be applied equivalently to other foam materials having other glass transition temperatures suitable for other types of packaged contents.

Figure 1:
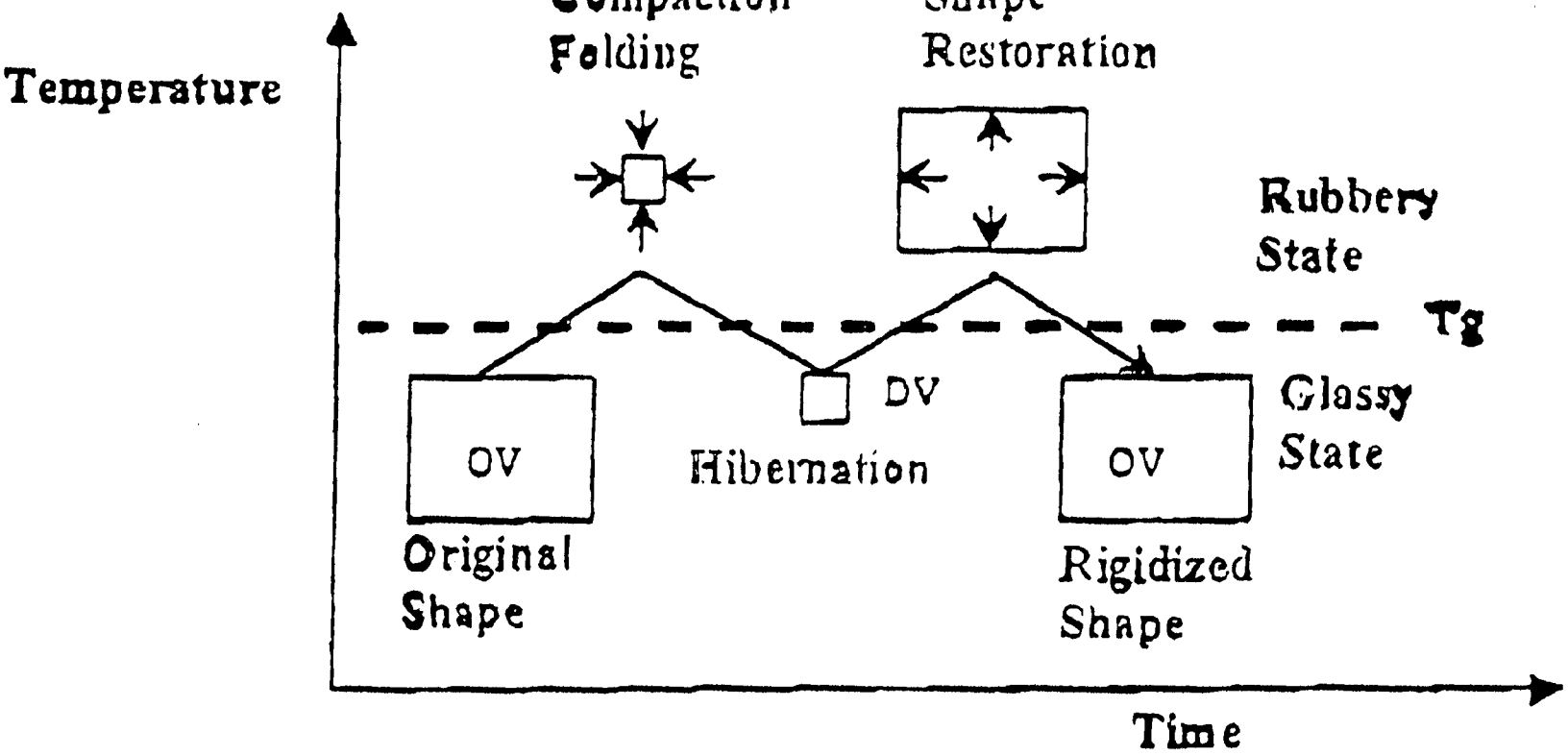
FIG. 1 is a diagram illustrating the thermal memory cycle of original shape (volume), compaction to a densified shape (volume), and shape restoration of a cold hibernation elastic memory (CHEM) foam material used in the invention.

FIG. 1 shows the thermal memory cycle of a CHEM foam material, as illustrated in the Sokolowski Article. The CHEM material is formed as a foam having an original shape with an open celled structure filling a certain original volume (OV). By applying heat about 15–20° C. above its glass transition temperature Tg, the foam is heated to a pliable or "rubbery" state in which it can be compressed, compacted, or otherwise shaped into a densified form. The densified volume (DV) of the compressed or compacted CHEM foam can be as little as 5% or less of its expanded size. The heat is then removed and the foam cools below the glass transition temperature to retain its densified shape and volume, a state referred to as "hibernation". In the densified, hibernation state, the foam can be handled and worked as packing or packaging material around a article, such as a bottle, vial, or carton of pharmaceutical contents. If the packaged article is subjected to heat such that the temperature of the densified foam reaches or exceeds its glass transition temperature, the densified foam re-expands and is restored to substantially its original shape and volume. If the heat is now removed, the restored shape will become rigidized in the glassy state in substantially its original shape and volume. It is this cycle that is used in the present invention as an indicator for heat damage in packaging safety applications.

Figure 2:
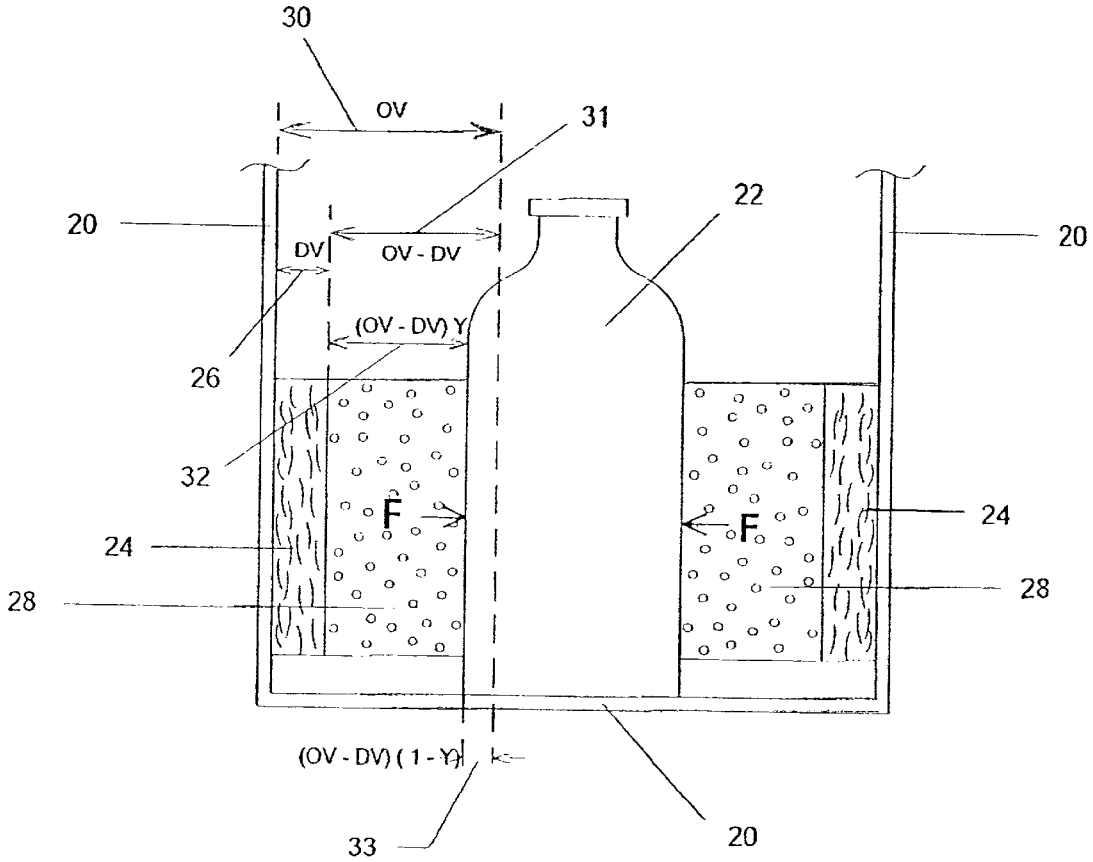
FIG. 2 is a schematic illustration of the use of densified foam as packing material for a packaging safety application which provides both a physical and visual indicator of heat damage of the contents of a packaged article.

Referring to FIG. 2, an example is shown of the use of the densified CHEM foam as a packing material in a first packaging safety application. In this application, the CHEM foam acts as both a physical and visual indicator for heat damage of the contents of a packaged article by compressing against and holding the article with sufficient force such that it cannot be readily removed from its package carton. The package carton has walls 20 to which inserts of densified foam 24 in the hibernation state are adhered or laminated. The densified foam has a densified volume 26, designated as DV, which leaves a free space either between the walls 20 and foam inserts 24 or, as illustrated in FIG. 2, between the article 22 in the carton and inserts 24. This free space 32, which is the space available for unconstrained foam expansion within the package, is defined as (OV−DV)*Y. If the packaged article is subsequently exposed to heat, which results in the glass transition temperature of the foam being exceeded, such as during storage or transportation, the foam re-expands and tends to be restored to substantially its original volume 30, designated as OV. The volume factor Y in this example is less than 1 and is selected such that a compressive force F is exerted by the expanding foam 28 against the article 22, such that the article cannot be readily removed from the foam/package system. This would indicate to the purchaser or consumer that the article has been heat-damaged, so that they can avoid use of the article and return it to the vendor.

For sake of illustration, both the compacted foam inserts 24 and the expanded foam 28 are shown in FIG. 2. If the article 22 in FIG. 2 were not present in the package, and the densified foam was allowed to expand without constraint, the foam would expand by an amount 31 equal to (OV−DV). With the article 22 present in the package, the expanded foam will be constrained by an amount 33 which is equal to (OV−DV)*(1−Y).

Alternatively, the volume OV may be selected to exceed the free space in the carton so as to cause the carton walls 20 to deform and buckle outwardly. This would indicate to the inventory manager, stocking clerk, sales clerk or consumer that the packaged article has been heat damaged. The dimensions of different types of cartons will vary widely. The CHEM foam is chosen and formed with predetermined original volume OV and subsequently densified to a volume DV depending on the particular dimensions and desired free space in the carton. Due to the high rigidity of the restored foam, the volume factor Y can be reliably selected by calculation of the desired amount of force to be exerted to immobilize the article or deform the carton walls.

Figure 3:
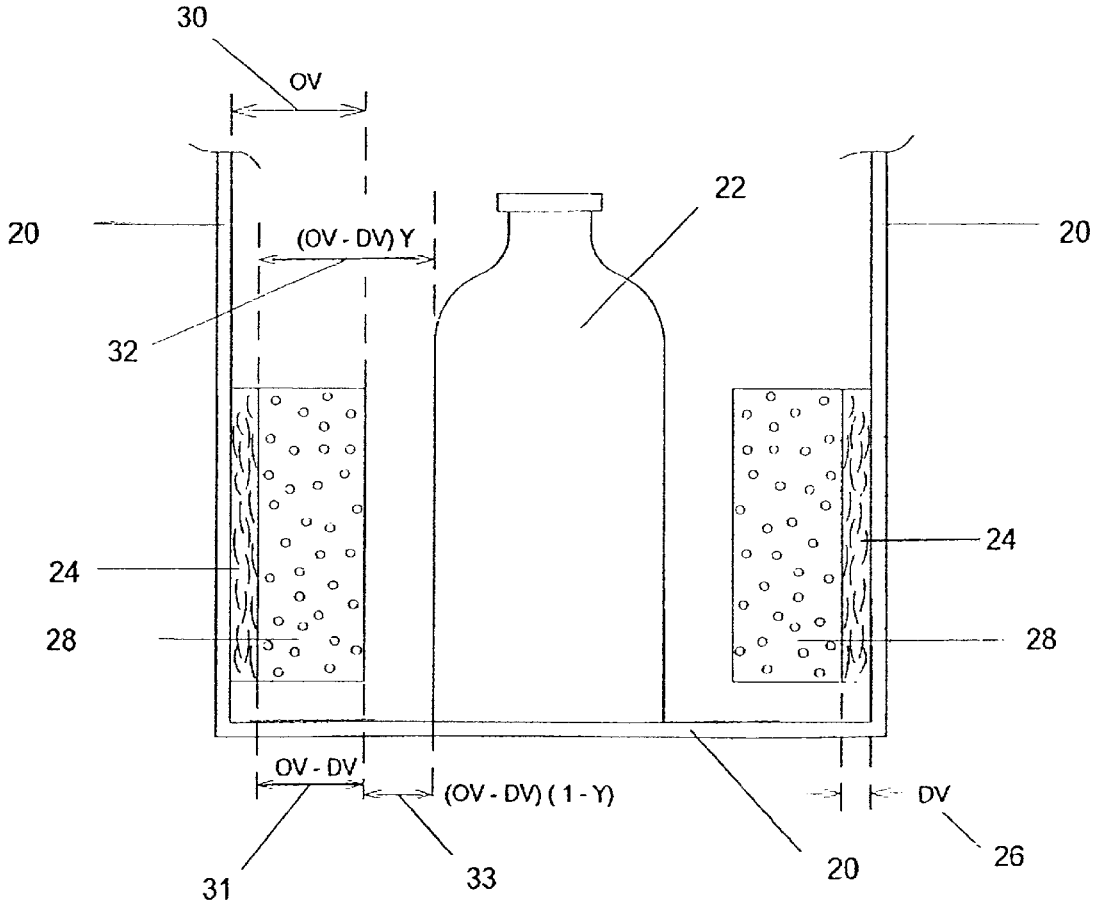
FIG. 3 is a schematic illustration of the use of densified foam as packing material for a packaging safety application which provides a visual indicator of heat damage of the contents of a packaged article.

Referring to FIG. 3, an example is shown of the use of the densified CHEM foam as a packing material in a second packaging safety application. In this application, the volume factor Y is greater than 1, which results in some amount of free space 33 remaining inside the package even after the foam has been fully re-expanded. There is therefore no compressive force applied to the contents 22 of the package. For such applications where Y is greater than 1, the person opening the package will immediately see a visual indicator that the package interior is not of normal or expected appearance. In this situation, written warnings of possible heat damage may be printed on the package wall, included inside the package, or a combination thereof.

In FIGS. 2 and 3, the original foam volume OV, the densified foam volume DV, and the free space (OV−DV)*Y available for unrestrained foam expansion inside the carton are all shown schematically in one dimension. It is to be understood that as used herein, "free space" is meant to denote substantially one dimension, and that dimension is aligned with the primary direction of the foam expansion. The fact that the expanded foam 28 in FIG. 2 will not fill the corner regions of the interior of the carton does not impact the usefulness of this invention.

In the simplest embodiment, pre-compacted CHEM structures can simply be inserted into a carton between the article and the carton walls. The structures can also be bonded to the carton walls or to the article inside the carton with an adhesive or other means. Since compaction volumes to as little as 5% or lower of the expanded volumes can be formed, the compressed insert takes relatively little space and can be easily fitted into the free space of most conventional package configurations. For example, a typical carton for a medicine vial can have inside dimensions of about 35×35 mm, and the vial has about a 22.0 mm diameter. This leaves a free space of about 6.5 mm on each side. The compressed foam insert can be formed as a thin sheet about 0.5 to 1 mm in thickness, which will expand to about 7.0 mm to 10 mm in thickness if it were not restrained by either the carton wall or vial. The over-thickness of 0.5 mm to 3.5 mm on one or more sides of the vial (which may be wrapped with product data sheet) exerts sufficient pressure to prevent the vial from being readily removed from the carton. As used herein, over-thickness in FIG. 2 and FIG. 3 is defined as (OV−DV)*(1−Y).

Note that for packaging systems where the volume factor Y is less than 1, the calculated over-thickness is greater than zero, indicating that the foam will exert a compressive force on the package contents when the foam is exposed to temperatures greater than its Tg. For packaging systems where Y is greater than one, the calculated over-thickness is less than zero, indicating that the package contents will not be subjected to a compressive force. For packaging systems where Y is equal to 1, the calculated overthickness is zero.

Test samples were made of thin strips of CHEM material having a glass transition temperature Tg of about 126° F. (52° C.) and an expanded density of approximately 0.07 g/cm$^3$. Other samples were made with a CHEM material having a Tg of about 144° F. (63° C.) and an expanded density of approximately 0.03 g/cm$^3$. The samples, in their compressed state, were lightly glued to the insides of an insulin vial carton. The carton, with vial and product information sheets inserted, was gently heated to approximately 10° F. above the foam's respective Tg for 3 minutes. After allowing the carton to cool to room temperature, a visual inspection showed that the foam had re-expanded to completely fill the free space in the carton, and unexpectedly, removal of the medicine vial from the foam package was extremely difficult.

Figure 4:
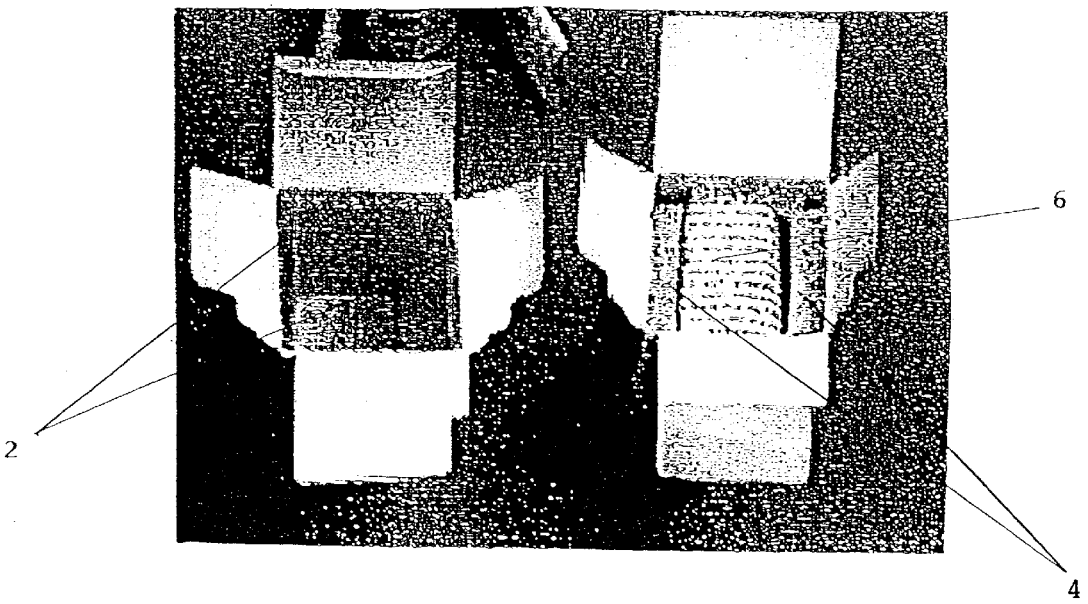
FIG. 4 is a photographic illustration showing carton packing inserts made of CHEM foam material in densified form and with its original volume restored around an article packed in a carton.

FIG. 4 illustrates a carton with compacted inserts 2 of CHEM foam material on the left hand side, and with the foam material 4 re-expanded on the right hand side. In this test, it was found that the vial 6 could not be removed from the package without tearing or destroying the package.

In another embodiment of the present invention, the compressed foam is used as a heat-damage indicator in a panel located within a wall of the carton that can be externally inspected, rather than as an insert inside the carton. In this version, exposure of the carton to temperatures at or above the foam Tg results in the re-expanded foam material rupturing the panel outwardly, so that its ruptured state is readily visible. In this manner, sale, distribution or use of the heat-damaged article can be avoided.

Figure 5:
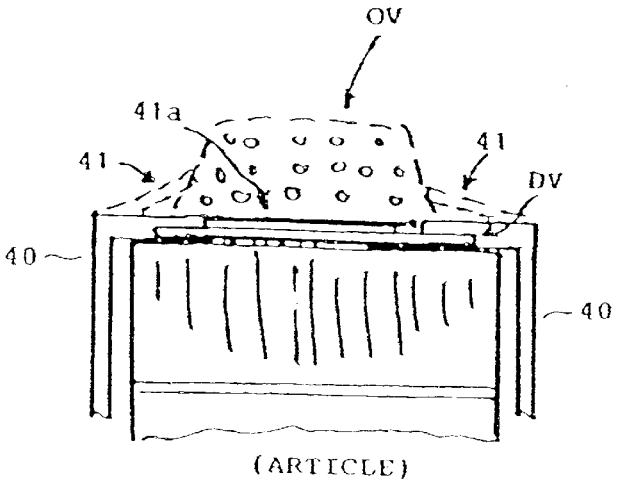
FIG. 5 is a schematic illustration of the use of densified foam layer in a panel of a carton for a packaging safety application to indicate heat damage to the contents of a packaged article.

Referring to FIG. 5, an example of the heat-damage indicator panel is shown schematically. The carton has side walls 40 and a top panel 41 above the article in the carton. The top panel 41 has an aperture and a compressed foam chip DV mounted at its inner surface adjacent the top of the article (vial). The aperture in the top panel may be sealed with a film 41*a*, which may be transparent or opaque, to prevent any moisture from getting to the compressed foam chip, or to prevent the chip otherwise becoming damaged or dislodged before it serves its function. When the carton with the packaged article is exposed to a temperature at or above the foam Tg, the foam re-expands to its original volume OV which can be 10x or 20x its densified volume DV. The bulk of the expanded foam causes the film in the aperture to be ruptured and the panel surface to be pushed outwardly (dashed lines). In this state, it is a clear indication to anyone that the carton has been exposed to a temperature greater than the temperature that is recommended for the package contents.

The use of the thermal memory foam in accordance with the present invention provides a clear and distinctive indication that the contents of the package have been exposed to temperatures greater than recommended or considered safe. In the insert mode, the expanded volume of the foam is used to make the contents difficult to physically remove. The inserts also provide a thermal insulating layer between a heat source and the package contents, thereby protecting the contents at lesser temperatures which might cause some damage. The inserts may be made in a variety of shapes, as desired, for example, plates, panels, discs, rings, etc. As long as the inserts have not been expanded, they can also be reused repeatedly, such as for carrier or delivery packages. If they have been expanded, they can also be re-compacted and reused. In the rupture mode, the foam deforms the package walls or ruptures an inspection panel so that the heat-damage indication is externally visible.

The expandable foam materials can be designed and manufactured in a wide range of glass transition temperatures, densified volumes, and original volumes, depending upon the dimensions and configurations of the packaging they are to be used with. They can also be made in a variety of cell sizes and colors, or printed or laminated with other materials. The thermal memory foam can thus be used as an indicator for heat damage for a wide range of goods and products, including pharmaceuticals, food, beverages, medical packaging (e.g., vaccines, medicines, body parts), etc. The activation of the foam in a matter of a few minutes is long enough to eliminate short heat transition effects, but long enough to register when enough heat has been applied that could damage sensitive contents such as pharmaceuticals and medicines.

The carton holding the heat sensitive contents shall be containers of various sizes and shapes, and made from paperboard, plastic, metal or other such materials.

It is understood that many modifications and variations may be devised given the above description of the principles of the invention. It is intended that all such modifications and variations be considered as within the spirit and scope of this invention, as it is defined in the following claims.

I claim:

1. A method for packaging an article which contains heat-sensitive contents that may be damaged by exposure to temperatures above a predetermined threshold temperature Tt comprising:

selecting an open cellular foam material having a thermal memory characteristic at a glass transition temperature Tg which is approximately equal to or greater than the predetermined threshold temperature of the contents of the article;

forming the foam material to an original foamed volume OV;

compressing the foam material at an elevated temperature above its glass transition temperature Tg to a selected densified volume DV;

cooling the densified foam material to a temperature below its Tg to retain it in the densified state;

applying the densified foam material in a carton with the article containing heat-sensitive contents leaving a free space in the carton, such that when a temperature exceeding the glass transition temperature Tg is applied to the carton, the foam material is re-expanded to substantially its original volume OV to indicate exposure to a temperature above the predetermined threshold temperature Tt.

2. A method according to claim 1, wherein said free space is equal to the quantity (OV–DV) multiplied by a volume factor Y.

3. A method according to claim 2, wherein said volume factor Y is less than 1.0, such that the foam material re-expands to a final volume exceeding the available free space inside the carton, resulting in a compressive force on the article and the carton, the compressive force being sufficient to deform the carton so that the deformation is visible externally.

4. A method according to claim 2, wherein said volume factor Y is less than 1.0, such that the foam material re-expands to completely fill the available free space inside the carton, resulting in a compressive force on the article, the compressive force being such, that the article cannot be readily removed from the carton.

5. A method according to claim 2, wherein said volume factor Y is equal to or greater than 1.0, such that the foam material re-expands without restraint and the re-expanded foam material provides a visual indicator of exposure to a temperature equal to or greater than said threshold temperature Tt.

6. A method according to claim 1, wherein said free space is located between the article and the densified foam material.

7. A method according to claim 6, wherein said densified foam material is in the form of a thin strip inserted along a wall of the carton.

8. A method according to claim 1, wherein said free space is located between a wall of the carton and the densified foam material.

9. A method according to claim 8, wherein said densified foam material is in the form of a thin strip inserted adjacent to the article.

10. A method according to claim 1, wherein said open cellular foam material is a polyurethane-based thermoplastic polymer.

11. A method according to claim 1, wherein said open cellular foam material is produced from butadiene liquid polymer, an activator and sulfur monochloride.

12. A method according to claim 1, wherein said re-expanded foam material deforms the carton walls so that the deformation is visible externally.

13. A method according to claim 1, wherein said re-expanded foam material presses against the article with sufficient force that it cannot be readily removed from the carton.

14. A method for packaging an article which contains heat-sensitive contents that may be damaged by exposure to a temperature above a predetermined threshold temperature Tt comprising:

placing the article into a carton;

selecting an open cellular foam material having a thermal memory characteristic at a glass transition temperature Tg which is approximately equal to or greater than the predetermined threshold temperature of the contents of the article;

forming the foam material to an original foamed volume OV;

compressing it at an elevated temperature above its glass transition temperature Tg to a selected densified volume DV;

cooling the densified foam material to a temperature below its Tg to retain it in the densified state;

applying the densified foam material to a heat-damage-indicating panel located within a wall of the carton having an inner surface adjacent the article and an outer surface visible externally of the carton which is rupturable by the re-expanded foam material applied to the heat-damage-indicating panel, such that when a temperature exceeding the glass transition temperature Tg is applied to the carton, the foam material in the heat-damage-indicating panel is re-expanded to substantially its original volume OV and thereby ruptures the outer surface of the panel to indicate that the contents of the article may be heat-damaged.

15. A method according to claim 14, wherein said open cellular foam material is a polyurethane-based thermoplastic polymer.

16. A method according to claim 14, wherein said open cellular foam material is produced from butadiene liquid polymer, an activator and sulfur monochloride.

17. A method according to claim 14, wherein said densified foam material is in the form of a thin chip mounted to an internal surface of the heat-damage-indicating panel of the carton adjacent the contents, and the panel has an aperture through which the re-expanded foam material pushes outwardly to provide an external indication of heat damage.

18. A method of manufacturing an indicator in the wall of a carton to determine heat damage to an article which contains heat-sensitive contents that may be damaged by exposure to a temperature above a predetermined threshold temperature Tt comprising:

selecting an open cellular foam material having a thermal memory characteristic at a glass transition temperature Tg which is approximately equal to or greater than the predetermined threshold temperature of the contents of the article;

forming the foam material to an original foamed volume OV;

compressing it at an elevated temperature above its glass transition temperature Tg to a selected densified volume DV;

cooling the densified foam material to a temperature below its Tg to retain it in the densified state;

applying the densified foam material to a heat-damage-indicating panel located within the wall of a carton having an inner surface adjacent the article and an outer surface visible externally of the carton which is rupturable by the re-expanded foam material applied to the heat-damage-indicating panel, such that when a temperature exceeding the glass transition temperature Tg is applied to the carton, the foam material in the heat-damage-indicating panel is re-expanded to substantially its original volume OV and thereby ruptures the outer surface of the panel to indicate that the contents of the article may be heat-damaged.

19. A method according to claim 18, wherein said open cellular foam material is a polyurethane-based thermoplastic polymer.

20. A method according to claim 14, wherein said open cellular foam material is produced from butadiene liquid polymer, an activator and sulfur monochloride.

21. A method according to claim 14, wherein said densified foam material is in the form of a thin chip mounted to an internal surface of the heat-damage-indicating panel of the carton adjacent the contents, and the panel has an aperture through which the re-expanded foam material pushes outwardly to provide an external indication of heat damage.

* * * * *